US009704469B2

(12) United States Patent
Jung

(10) Patent No.: US 9,704,469 B2
(45) Date of Patent: Jul. 11, 2017

(54) COMBUSTION NOISE-MASKING CONTROL APPARATUS AND METHOD

(71) Applicant: Hyundai Motor Company, Seoul (KR)

(72) Inventor: In Soo Jung, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/939,987

(22) Filed: Nov. 12, 2015

(65) Prior Publication Data

US 2016/0372105 A1 Dec. 22, 2016

(30) Foreign Application Priority Data

Jun. 18, 2015 (KR) ..... 10-2015-0086699

(51) Int. Cl.

| | |
|---|---|
| ***G10K 11/178*** | (2006.01) |
| ***F02D 41/28*** | (2006.01) |
| ***F02D 35/02*** | (2006.01) |

(52) U.S. Cl.

CPC ..... *G10K 11/178* (2013.01); *F02D 35/023* (2013.01); *F02D 2041/288* (2013.01); *F02D 2200/025* (2013.01); *G10K 2210/1282* (2013.01); *G10K 2210/3025* (2013.01); *G10K 2210/30231* (2013.01)

(58) Field of Classification Search

CPC ..... G10K 11/1788; G10K 2210/30231; G10K 2210/1282; G10K 2210/107; F02D 2200/025

See application file for complete search history.

(56) References Cited

U.S. PATENT DOCUMENTS

| | | | | |
|---|---|---|---|---|
| 2009/0188382 | A1* | 7/2009 | Hallgren | F41F 3/052 89/1.8 |
| 2015/0030175 | A1* | 1/2015 | Roggenkamp | G10K 11/002 381/73.1 |
| 2015/0043744 | A1* | 2/2015 | Lagodzinski | H04R 3/002 381/73.1 |
| 2016/0284333 | A1* | 9/2016 | Weston | G10K 11/175 |

FOREIGN PATENT DOCUMENTS

| | | | |
|---|---|---|---|
| JP | 05-058811 | U | 8/1993 |
| JP | 4200988 | | 12/2008 |
| JP | 2012-254796 | A | 12/2012 |
| JP | 5507616 | | 5/2014 |
| KR | 10-2003-0050260 | A | 6/2003 |
| KR | 100534869 | | 12/2005 |

* cited by examiner

*Primary Examiner* — Ping Lee
(74) *Attorney, Agent, or Firm* — Brinks Gilson & Lione

(57) ABSTRACT

A vehicle combustion noise-masking control method is provided that includes the steps of determining whether a combustion noise that is equal to or greater than a predetermined level is generated in a driving condition of a vehicle engine, determining whether the level of the combustion noise generated in the driving condition is within a predetermined range, and outputting a masking sound reducing the combustion noise to the inside of the vehicle when the level of the combustion noise is within the predetermined range.

6 Claims, 11 Drawing Sheets

COMBUSTION NOISE-MASKING CONTROL APPARATUS AND METHOD

CROSS-REFERENCE TO RELATED APPLICATIONS

This application claims the benefit of Korean Patent Application No. 10-2015-0086699 filed on Jun. 18, 2015, the contents of which are incorporated herein by reference in its entirety.

FIELD

The present disclosure relates to a vehicle combustion noise-masking control apparatus and method that are capable of effectively masking a high frequency combustion noise generated in a vehicle.

BACKGROUND

The statements in this section merely provide background information related to the present disclosure and may not constitute prior art.

Generally, while a vehicle is being driven, a combustion noise is generated in an engine compartment of the vehicle and flows into an interior of the vehicle.

Such a combustion noise may be generated and propagate into the interior of the vehicle in various magnitudes depending on opening angles of engine valves associated with an engine rotation speed and an effort of an accelerator pedal, the number of passengers, or various temperature conditions of the interior of the vehicle.

The combustion noise is generated as a low frequency combustion noise or a high frequency combustion noise depending on a driving condition of the vehicle. The low frequency combustion noise may be reduced by calculating a phase of the low frequency combustion noise and then outputting a reverse-phase sound through a speaker installed in the interior of the vehicle.

However, it is difficult to effectively reduce a high frequency combustion noise generated in the engine compartment of the vehicle. Accordingly, while a vehicle is being driven, a driver may feel a sense of fatigue due to the high frequency combustion noise.

SUMMARY

The present disclosure provides a vehicle combustion noise-masking control apparatus and method that effectively reduce a high frequency combustion noise generated in a vehicle.

One form of the present disclosure provides a vehicle combustion noise-masking control method, including: determining whether a combustion noise that is equal to or greater than a predetermined level is generated in a driving condition of a vehicle engine; determining whether the level of the combustion noise generated in the driving condition is within a predetermined range; and outputting a masking sound reducing the combustion noise into the inside of the vehicle when the level of the combustion noise is within the predetermined range.

The driving condition may include at least one a position of an accelerator pedal, an engine RPM, or a gear ratio, but may other driving conditions of the vehicle.

The combustion noise may be measured by a microphone installed in the vehicle.

The level of the combustion noise may be calculated as a numerical value of weighted decibels (dBA) in which a weight value is applied to decibels (dB).

The masking sound may be outputted through a speaker installed inside the vehicle when the numerical value is within the predetermined range.

The speaker may output a masking sound that has a frequency equal to or less than about 700 Hz.

A combustion pressure measured by a combustion pressure sensor installed in the vehicle is calculated in a numerical value as the level of the combustion noise.

Determining whether the level of the combustion noise generated in the driving condition is within a predetermined range includes: measuring a combustion pressure with a frequency and amplitude by using the combustion pressure sensor installed in the vehicle; converting the measured combustion pressure through a fast Fourier transform (FFT) to determine a cylinder pressure level; and calculating a combustion noise index through the following equation based on the cylinder pressure level to determine the numerical value.

$$CNI = \left(10\log\left(10^{xkHz\left(\frac{I}{10}\right)}\right) + \ldots + 10\log\left(10^{xkHz\left(\frac{I}{10}\right)}\right)\right) \quad \text{[Equation]}$$

In the equation, CNI is a combustion noise index, x is a frequency, and I is a level of noise.

Another form of the present disclosure provides a vehicle combustion noise-masking control apparatus, including: a microphone measuring a level of a combustion noise when a combustion noise equal to or greater than a predetermined level is generated in a driving condition of a vehicle engine; a speaker that is installed inside the vehicle and outputs a sound; and a controller that identifies whether the level of the combustion noise transmitted from the microphone is within a predetermined range and that controls the speaker so that a masking sound reducing the combustion noise is outputted when the level of the combustion noise is within the predetermined range.

The speaker may output a masking sound that has a frequency equal to or less than about 700 Hz.

The controller may calculate the level of the combustion noise in a numerical value of weighted decibels (dBA) in which a weight value is applied to decibels (dB).

Yet another form of the present disclosure provides a vehicle combustion noise-masking control apparatus, including: a combustion pressure sensor measuring a level of a combustion pressure when a combustion noise equal to or greater than a predetermined level is generated in a driving condition of a vehicle engine; a speaker that is installed inside the vehicle and outputs a sound; and a controller that calculates the combustion pressure measured by the combustion pressure sensor in a numerical value, identifies whether the calculated numerical value is within a predetermined range, and controls the speaker so that a masking sound reducing the combustion noise is outputted when a level of the combustion noise is within the predetermined range.

The controller may convert the combustion pressure through a fast Fourier transform (FFT) to determine a cylinder pressure level, and may calculate a combustion noise index through the following equation based on the cylinder pressure level to determine the numerical value.

$$CNI = \left(10\log\left(10^{xkHz\left(\frac{I}{10}\right)}\right) + \ldots + 10\log\left(10^{xkHz\left(\frac{I}{10}\right)}\right)\right) \quad \text{[Equation]}$$

In the equation, CNI is a combustion noise index, x is a frequency, and I is a level of noise.

The speaker may output a masking sound that has a frequency equal to or less than about 700 Hz.

According to one form of the present disclosure, it is possible to identify a level of a combustion noise by calculating a combustion noise index corresponding to a high frequency combustion noise according to a vehicle-driving condition and to output a masking sound corresponding to a level of the high frequency combustion noise in the vehicle. Accordingly, a high frequency combustion noise generated depending on a driving condition of the vehicle may be effectively reduced, thereby improving vehicle-driving satisfaction.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
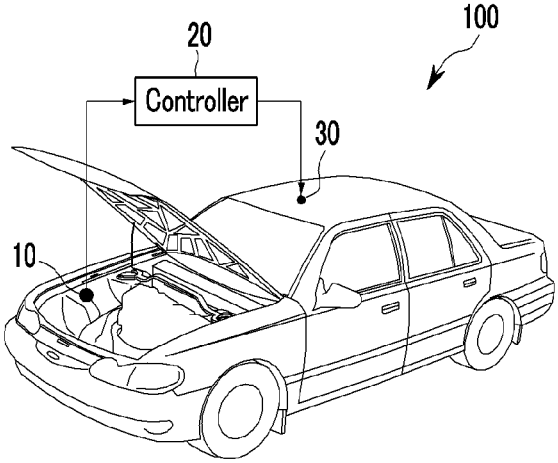
FIG. 1 illustrates a schematic perspective view of a vehicle combustion noise-masking control apparatus according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features FIG. 1 illustrates a schematic perspective view of a vehicle combustion noise-masking control apparatus according to one form of the present disclosure, and FIG. 2 illustrates a schematic block diagram of the vehicle combustion noise-masking control apparatus of FIG. 1.

Figure 2:
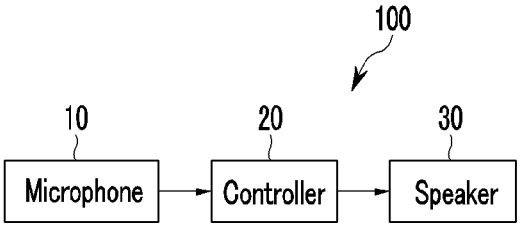
FIG. 2 illustrates a schematic block diagram of the vehicle combustion noise-masking control apparatus of FIG. 1.

As shown in FIGS. 1 and 2, a vehicle combustion noise-masking control apparatus 100 according to one form of the present disclosure includes a microphone 10 measuring a level of a combustion noise when a driving condition of a vehicle engine reaches a predetermined driving condition at which a combustion noise equal to or greater than a predetermined level is generated, a controller 20 identifying whether the level of the combustion noise transmitted from the microphone 10 is within a predetermined range, and a speaker 30 outputting a masking sound for reducing the combustion noise into the vehicle when it is identified by the controller 20 that the level of the combustion noise is within the predetermined range.

The predetermined driving condition, in which the combustion noise equal to or greater than the predetermined level is generated, is when at least one of certain driving conditions, such as a position of an accelerator pedal, an engine RPM, a gear ratio, etc., satisfies a predetermined condition. This is to identify the at least one driving condition, such as the position of the accelerator pedal, the engine RPM, the gear ratio, etc., and then to determine whether a combustion noise generated while the vehicle is being driven is in a range of a predetermined level. Here, the determining of the predetermined condition for the driving conditions may be randomly set by a user, or may be set in a predetermined range.

When the driving condition of the vehicle is identified to reach the predetermined driving condition, the level of the combustion noise may be identified by using the microphone 10.

The microphone 10 may be installed in an engine compartment of the vehicle to measure the level of the combustion noise. The level of the combustion noise measured by the microphone 10 is transmitted to the controller 20.

The controller 20 receives a signal level of the combustion noise measured by the microphone 10 and calculates it in a numerical value. More specifically, the numerical value may be calculated as weighted decibels (dBA) converted in a relative unit (decibel: dB) by applying a weight value so that the measured combustion noise is represented as a level of a sound that people can recognize.

When the numerical value, which is the weighted decibel (dBA) of the combustion noise, is within the predetermined range, it is determined that a passenger can recognize the measured combustion noise as a sound. In contrast, when the weighted decibel (dBA) exceeds the predetermined range, it may be determined that the passenger cannot recognize the measured combustion noise as a sound. That is, that the weighted decibel (dBA) is within the predetermined range means that a combustion noise is generated to a degree at which the driver or passenger undergoes driving disturbance.

When it is identified that the level of the combustion noise is within the predetermined range, the masking sound reducing the combustion noise may be outputted through the speaker 30 installed inside the vehicle. A frequency of the masking sound outputted through the speaker may be equal to or less than about 700 Hz. Such a frequency of the masking sound may be varied depending on the weighted decibels.

As described above, when the combustion noise generated in the engine compartment of the vehicle is within the predetermined range in the predetermined driving condition, the speaker of the vehicle combustion noise-masking control apparatus may output a masking sound with a frequency equal to or less than about 700 Hz. Accordingly, the high frequency combustion noise generated in the vehicle may be effectively masked, thereby improving the driving satisfaction of the driver.

Figure 3:
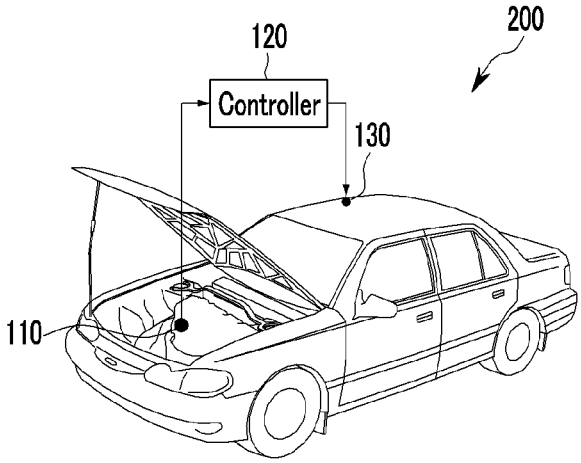
FIG. 3 illustrates a schematic perspective view of a vehicle combustion noise-masking control apparatus according to another form of the present disclosure.
Figure 4:
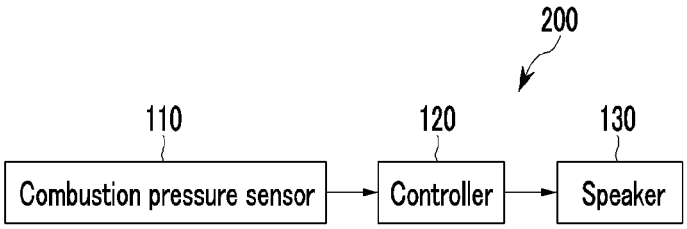
FIG. 4 illustrates a schematic block diagram of the vehicle combustion noise-masking control apparatus of FIG. 3.

FIG. 3 illustrates a schematic perspective view of a vehicle combustion noise-masking control apparatus according to another form of the present disclosure, and FIG. 4 illustrates a schematic block diagram of the vehicle combustion noise-masking control apparatus of FIG. 3. The same reference numerals as those in FIGS. 1 and 2 refer to the same or like members having the same or like functions. A detailed description of the same reference numerals will be omitted hereinafter.

As shown in FIGS. 3 and 4, a vehicle combustion noise-masking control apparatus 200 according to another form of the present disclosure includes a combustion pressure sensor 110 measuring a level of a combustion pressure when a driving condition of a vehicle engine reaches a predetermined driving condition at which a combustion noise equal to or greater than a predetermined level is generated, a controller 120 that calculates the combustion pressure measured by the combustion pressure sensor 110 in a numerical value and then identifies whether the calculated numerical value is within a predetermined range, and a speaker 130 outputting a masking sound for reducing the combustion noise into the vehicle when it is identified that the calculated numerical value by the controller 120 is within the predetermined range.

The predetermined driving condition, in which the combustion noise equal to or greater than the predetermined level is generated, is at least one of certain driving conditions, such as a position of an accelerator pedal, an engine RPM, a gear ratio, etc., satisfy a predetermined condition. This is to identify at least one driving condition, such as the position of the accelerator pedal, the engine RPM, the gear ratio, etc., and then to determine whether a combustion noise generated while the vehicle is being driven is in a range of a predetermined level. Here, the determining of the predetermined condition for the driving conditions may be randomly set by a user, or may be set in a predetermined range.

When the driving condition of the vehicle is identified to reach the predetermined driving condition, the level of the combustion noise may be identified by using combustion pressure sensor 110.

The combustion pressure sensor 110 may measure a combustion pressure having a frequency and amplitude and then transmit the measured combustion pressure to the controller 120.

The controller 120 converts the combustion pressure measured by combustion pressure sensor 110 through the fast Fourier transform (FFT) to determine a cylinder pressure level. Further, the controller 120 converts the cylinder pressure level (CPL) into a numeral level (dB) through the FFT. Subsequently, the controller 120 may calculate a combustion noise index (CNI) by using the converted cylinder pressure level (CPL). The combustion noise index (CNI) may be calculated by the following equation.

$$CNI = \left(10\log\left(10^{xkHz\left(\frac{I}{10}\right)}\right) + \ldots + 10\log\left(10^{xkHz\left(\frac{I}{10}\right)}\right)\right) \quad \text{[Equation]}$$

In the equation, CNI is a combustion noise index, x is a frequency, and I is a level of noise.

When it is identified that the level of the combustion noise calculated by using the combustion noise index (CNI) is within the predetermined range, the masking sound reducing the combustion noise is outputted through the speaker 130 installed inside the vehicle. A frequency of the masking sound outputted through the speaker 130 may be equal to or less than about 700 Hz. Such a frequency of the masking sound may be varied depending on the weighted decibels.

As described above, when the index of the combustion noise generated in the engine compartment of the vehicle is within the predetermined range in the predetermined driving condition, the speaker of the vehicle combustion noise-masking control apparatus may output a masking sound with a frequency equal to or less than about 700 Hz. Accordingly, the high frequency combustion noise generated in the vehicle may be effectively masked, thereby improving the driving satisfaction of the driver.

Figure 5:
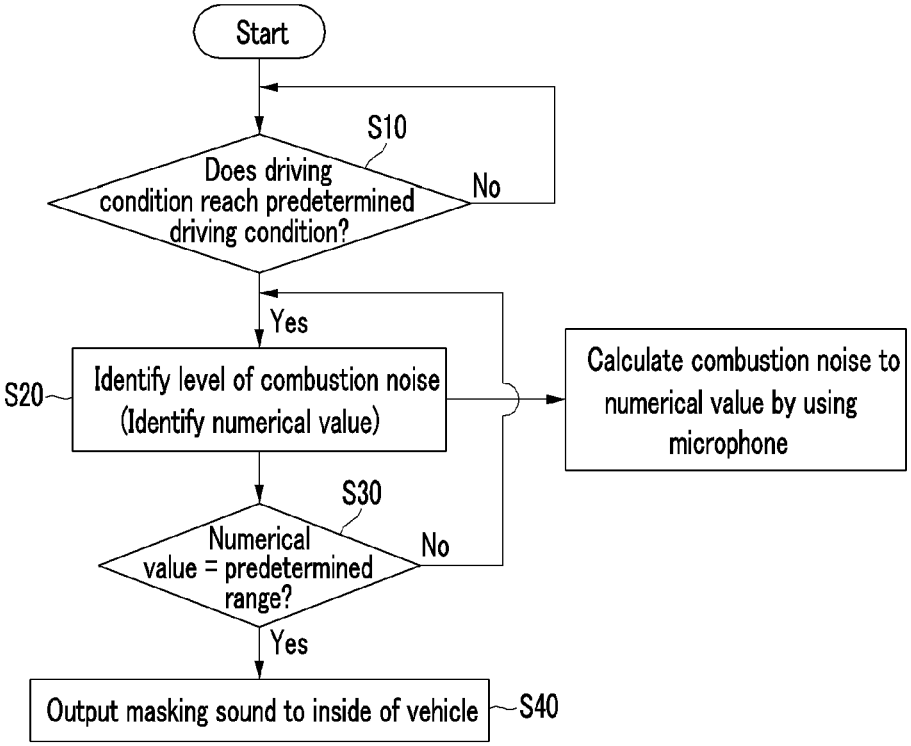
FIG. 5 illustrates a flowchart of a vehicle combustion noise-masking control method according to one form of the present disclosure.

FIG. 5 illustrates a flowchart of a vehicle combustion noise-masking control method according to one form of the present disclosure. The same reference numerals as those in FIGS. 1 to 4 refer to the same or like members having the same or like functions. A detailed description of the same reference numerals will be omitted hereinafter. A vehicle combustion noise-masking control method according to one form of the present disclosure will now be described in detail with reference to FIG. 5.

First, it is identified or determined whether the driving condition of the vehicle engine reaches the predetermined driving condition in which the combustion noise equal to or greater than the predetermined level is generated (S10). This is to identify at least one driving condition, such as the position of the accelerator pedal, the engine RPM, the gear ratio, etc., and then to determine whether a combustion noise generated while the vehicle is being driven is in a range of a predetermined level. In step S10, while the vehicle is being driven, it is determine whether the at least one driving condition, such as the position of the accelerator pedal, the engine RPM, the gear ratio, etc., satisfies the predetermined condition.

As such, to identify the driving conditions such as the position of the accelerator pedal, the engine RPM, the gear ratio, etc., in step S10 is to identify whether a combustion noise generated while the vehicle is being driven is within a range of a predetermined level. In step 10, the determining of the predetermined condition for the driving conditions may be randomly set by a user, or may be set in a predetermined range.

When it is identified that the driving condition of the vehicle reaches the predetermined driving condition in step 10, the level of the combustion noise may be identified (S20). In step S20, the level of the combustion noise may be measured by the microphone installed in the engine compartment of the vehicle.

In step S20, the level of the combustion noise measured by the microphone is calculated as a numerical value. More specifically, the numerical value may be calculated as weighted decibels (dBA) converted in a relative unit (decibel: dB) by applying a weight value so that the measured combustion noise is represented as a level of a sound that people can recognize, in step S20.

Subsequently, whether the numerical value, which is the weighted decibel (dBA) of the combustion noise, is within the predetermined range is identified (S30). When the numerical value, which is the weighted decibel (dBA) of the combustion noise, is within the predetermined range, it is determined that a passenger can recognize the measured combustion noise as a sound. In contrast, when the weighted decibel (dBA) exceeds the predetermined range, it may be determined that the passenger cannot recognize the measured combustion noise as a sound. That is, that the weighted decibel (dBA) is within the predetermined range means that a combustion noise is generated to a degree at which the driver or passenger undergoes driving disturbance.

When it is identified that the level of the combustion noise is within the predetermined range in step S30, the masking sound reducing the combustion noise is outputted to the inside of the vehicle (S40). The masking sound may be outputted through the speaker installed inside the vehicle.

Figure 6:
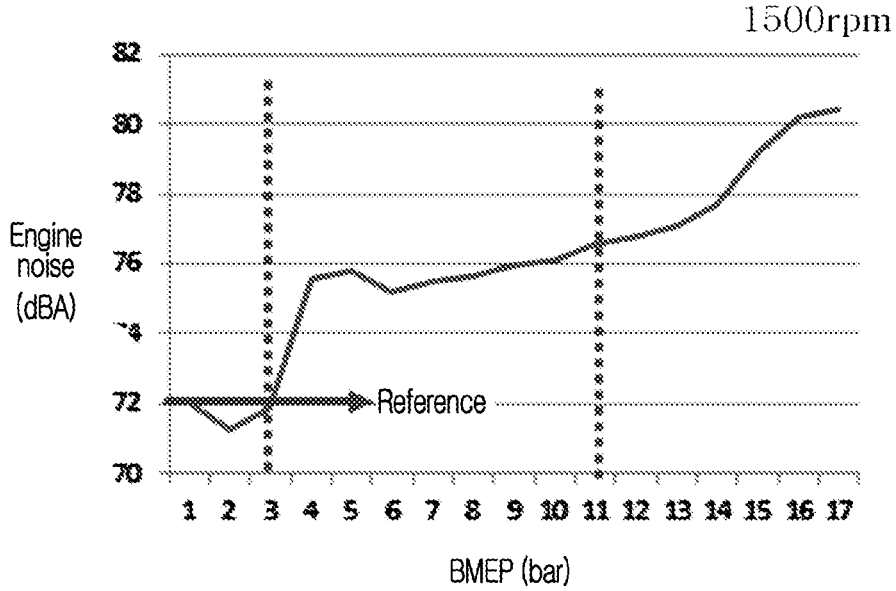
FIG. 6 illustrates a schematic graph of a numerical value for a combustion noise included in a predetermined range.

FIG. 6 illustrates a schematic graph of a numerical value for a combustion noise included in a predetermined range.

As shown in FIG. 6, it is illustrated that when weighted decibels (dBA) are within about 72 to 77 dBA in a range in which an engine speed is about 1500 RPM and a brake mean effective pressure (BMEP) is about 3 to 11 bar. Accordingly, when the weighted decibel (dBA) is within the predetermined range of about 72 to 77 dBA, it is described that a masking sound is outputted. However, the predetermined range of the weighted decibel (dBA) is not limited to about 72 to 77 dBA, but may be changed by the driver or passenger based on a driving condition of the vehicle.

The masking sound may be outputted through the speaker installed in the engine compartment of the vehicle in step S40. A frequency of the masking sound outputted through the speaker may be equal to or less than about 700 Hz in the present form. The frequency of the masking sound may be varied depending on the weighted decibels.

As described above, when the combustion noise generated in the engine compartment of the vehicle is within the predetermined range in the predetermined driving condition, the speaker using the vehicle combustion noise-masking control method of the present form may output a masking sound with a frequency equal to or less than about 700 Hz. Accordingly, the high frequency combustion noise generated in the vehicle may be effectively masked, thereby improving the driving satisfaction of the driver.

Figure 7:
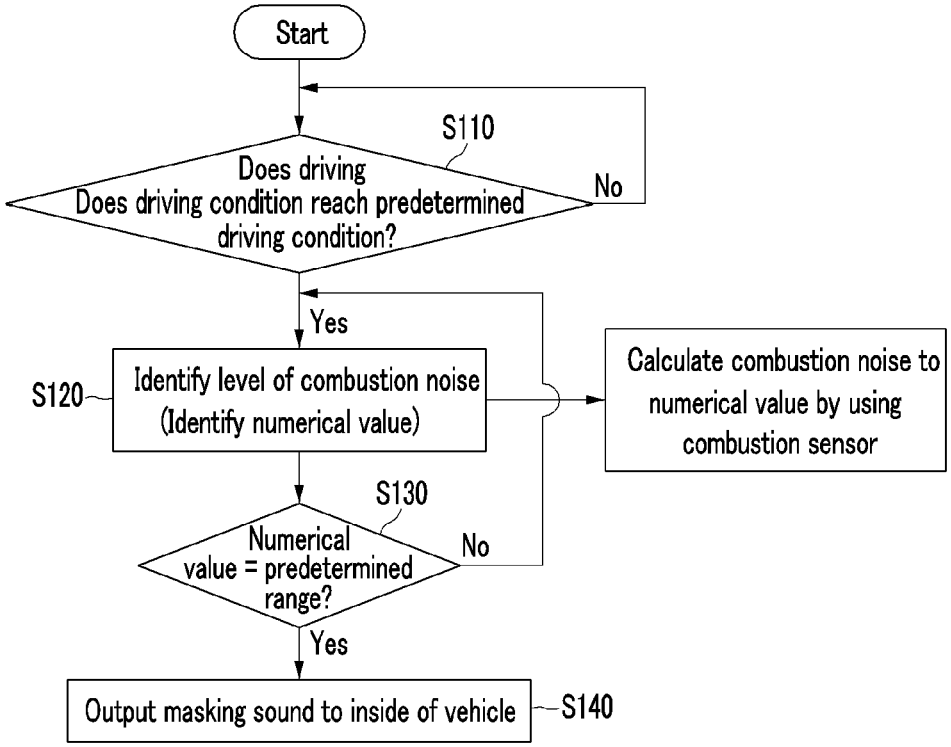
FIG. 7 illustrates a flowchart of a vehicle combustion noise-masking control method according to another form of the present disclosure.

FIG. 7 illustrates a flowchart of a vehicle combustion noise-masking control method according to another form of the present disclosure. A detailed description of the same reference numerals will be omitted hereinafter. A vehicle combustion noise-masking control method according to another form of the present disclosure will now be described in detail with reference to FIG. 7.

First, it is identified or determined whether the driving condition of the vehicle engine reaches the predetermined driving condition in which the combustion noise equal to or greater than the predetermined level is generated (S110). In step S110, while the vehicle is being driven, it is determine whether at least one of the driving conditions, such as the position of the accelerator pedal, the engine RPM, the gear ratio, etc., satisfies the predetermined condition.

In another example, to identify the driving condition as the position of the accelerator pedal, the engine RPM, the gear ratio, etc., step S110 is to identify whether a combustion noise generated while the vehicle is being driven is within a range of a predetermined level. In step 110, the determining of the predetermined condition for the driving conditions may be randomly set by a user, or may be set in a predetermined range.

When it is identified that the driving condition of the vehicle reaches the predetermined driving condition in step 110, the level of the combustion noise may be identified (S120). In step S120, the level of the combustion noise may be identified by calculating the combustion pressure measured by the combustion pressure sensor of the vehicle in the numerical value. That is, the numerical value of the combustion noise index may be calculated and identified by using the combustion pressure in step S120.

Figure 8:
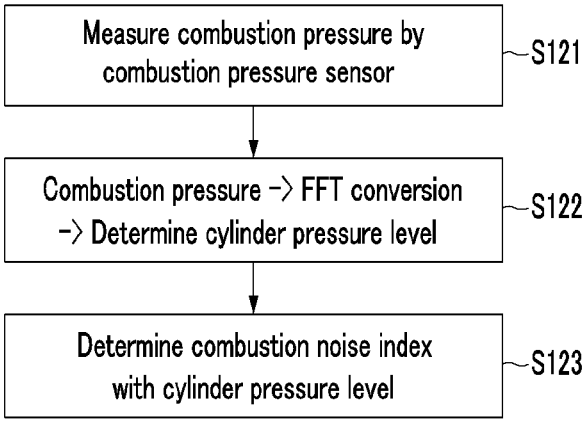
FIG. 8 illustrates a flowchart of a process in which a combustion noise index is calculated by the vehicle combustion noise-masking control method of FIG. 7.

FIG. 8 illustrates a flowchart of a process in which a combustion noise index is calculated by the vehicle combustion noise-masking control method of FIG. 7. Processes of calculating the combustion noise index will now be described in detail with reference to FIG. 8.

First, the combustion pressure is measured by the combustion pressure sensor installed in the vehicle (S121). The combustion pressure, which has a frequency and amplitude, is measured by the combustion pressure sensor, and then may be transmitted to a vehicle ECU, in step S121. The vehicle ECU may be applied as an electronic control unit.

Subsequently, the combustion pressure measured in step S121 is converted through a fast Fourier transform (FFT) to determine a cylinder pressure level (S122).

Figure 9:
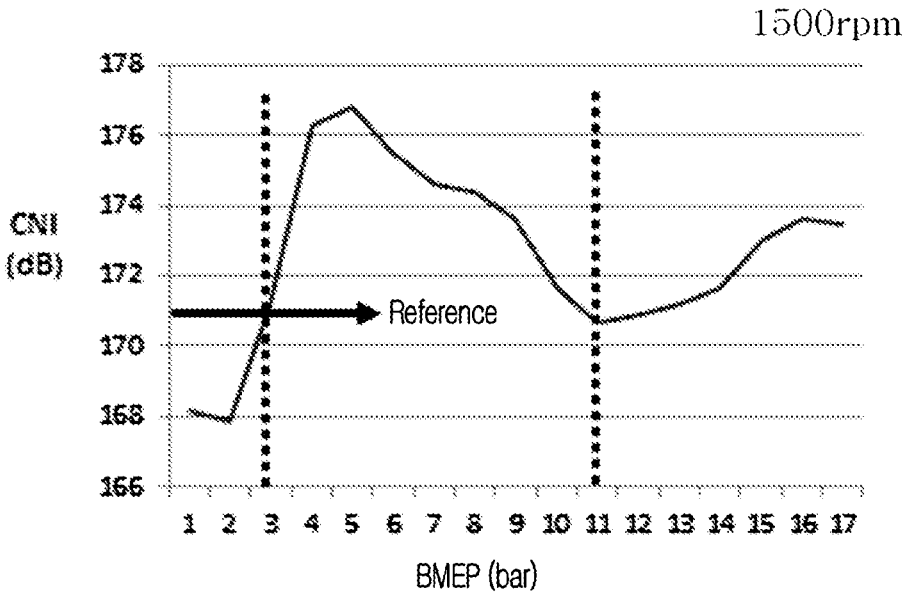
FIG. 9 illustrates a graph of a combustion pressure measured by a combustion pressure sensor.
Figure 10:
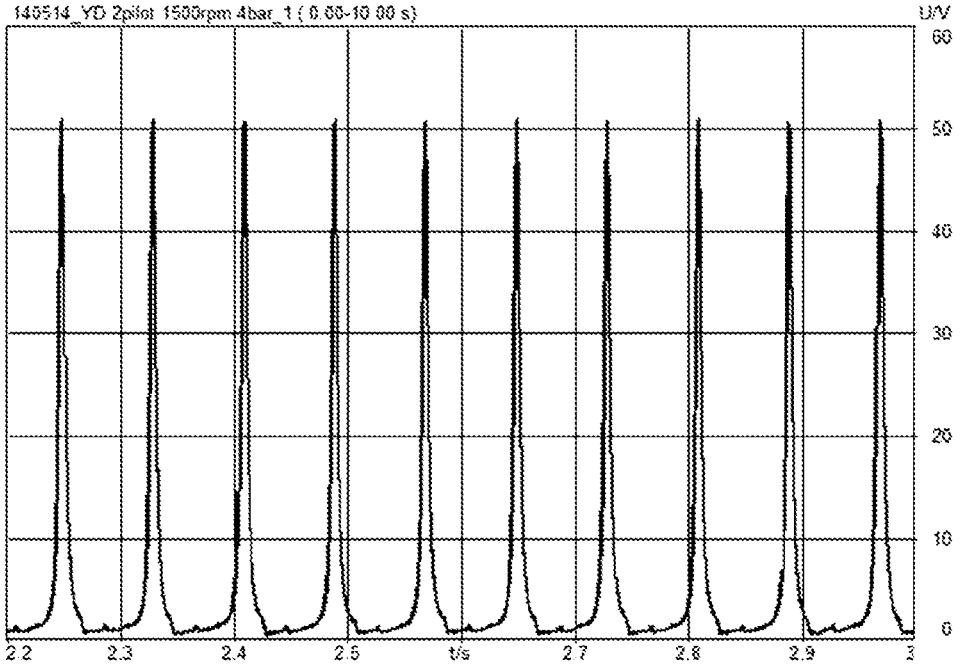
FIG. 10 illustrates a schematic graph of a state in which the combustion pressure of FIG. 9 is converted into a cylinder pressure level (dB) corresponding to a frequency by a fast Fourier transform (FFT)

FIG. 9 illustrates a graph of a combustion pressure measured by a combustion pressure sensor, and FIG. 10 illustrates a schematic graph of a state in which the combustion pressure of FIG. 9 is converted into a cylinder pressure level (dB) corresponding to a frequency by a FFT.

As shown FIGS. 9 and 10, the combustion pressure is converted into a numeral level (dB) for the cylinder pressure level (CPL) through the FFT.

The combustion noise index is calculated by using the cylinder pressure level (CPL) calculated in step S122 (S123). The combustion noise index (CNI) may be calculated by the following equation.

$$CNI = \left(10\log\left(10^{xkHz\left(\frac{I}{10}\right)}\right) + \ldots + 10\log\left(10^{xkHz\left(\frac{I}{10}\right)}\right)\right) \quad \text{[Equation]}$$

In the equation, CNI is a combustion noise index, x is a frequency, and I is a level of noise.

When it is identified that the level of the combustion noise calculated by using the combustion noise index (CNI) is within the predetermined range in step S123, the masking sound reducing the combustion noise is outputted to the inside of the vehicle (S140; refer to FIG. 3). The masking sound may be outputted through the speaker installed in the engine compartment of the vehicle in step S140. A frequency of the masking sound outputted through the speaker may be equal to or less than about 700 Hz in the present form.

Figure 11:
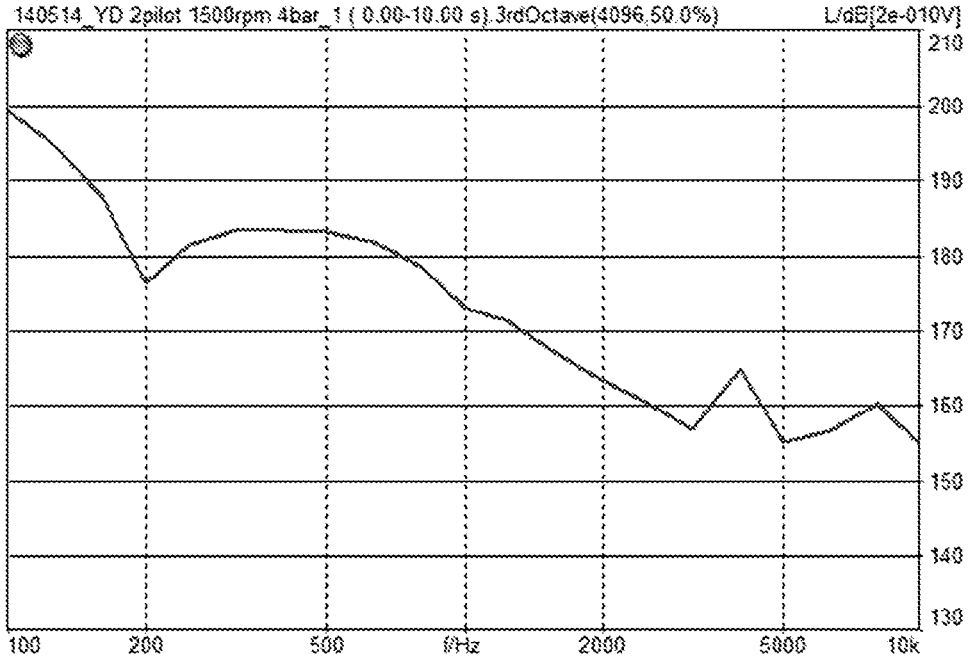
FIG. 11 illustrates a graph of the combustion noise index of FIG. 8 that is within a predetermined range.

FIG. 11 illustrates a graph of the combustion noise index of FIG. 8 that is within a predetermined range.

As shown in FIG. 11, it is illustrated that a combustion noise index (CNI) is equal to or greater than about 171 dB in a range in which an engine speed is about 1500 RPM and a brake mean effective pressure (BMEP) is about 3 to 11 bar. Accordingly, when the combustion noise index (CNI) is equal to or greater than about 171 dB in the range in which the engine speed is about 1500 RPM and the brake mean effective pressure (BMEP) is about 3 to 11 bar, in this form a masking sound is outputted. However, the predetermined range of the combustion noise index (CNI) is not limited to about 171 dB, but may be changed to another predetermined range depending on the selection by the driver or passenger.

As described above, when the index of the combustion noise generated in the engine compartment of the vehicle is within the predetermined range in the predetermined driving condition, the speaker may output a masking sound with a frequency equal to or less than about 700 Hz, by using the vehicle combustion noise-masking control method of the present form. Accordingly, the high frequency combustion noise generated in the vehicle may be effectively masked, thereby improving the driving satisfaction of the driver.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vehicle combustion noise-masking control method, comprising:

measuring a combustion pressure sensed by a combustion pressure sensor installed within a vehicle engine compartment;

calculating a level of the combustion noise to be the numerical value of measured combustion pressure;

determining whether the level of the combustion noise is equal to or greater than a predetermined level during a driving condition of a vehicle engine;

receiving a frequency and an amplitude of the combustion pressure as measured by the combustion pressure sensor;

determining a cylinder pressure level by converting the frequency and the amplitude of the combustion pressure through a fast Fourier transform (FFT); and calculating a combustion noise index based on the cylinder pressure level;

determining the level of the combustion noise generated in the driving condition is within a predetermined range when the combustion noise index is within the predetermined range; and outputting a masking sound reducing the combustion noise to the inside of the vehicle when the level of the combustion noise is within the predetermined range.

2. The vehicle combustion noise-masking control method of claim 1, wherein the driving condition includes at least one of the driving conditions selected from the group consisting of a position of an accelerator pedal, an engine RPM, or a gear ratio.

3. The vehicle combustion noise-masking control method of claim 1, wherein the masking sound is outputted through a speaker installed in the vehicle.

4. The vehicle combustion noise-masking control method of claim 3, wherein the speaker outputs the masking sound to have a frequency equal to or less than about 700 Hz.

5. A vehicle combustion noise-masking control apparatus included on a vehicle, the vehicle combustion noise-masking control apparatus comprising:

a combustion pressure sensor positioned within a vehicle engine compartment configured to measure a combustion pressure;

a speaker installed inside the vehicle and configured to output a sound; and a controller in communication with the combustion pressure sensor and the speaker, the controller configured to:

calculate a level of the combustion noise to be a numerical value of the measured combustion pressure;

determine whether the level of the combustion noise is equal to or greater than a predetermined level during a driving condition of a vehicle engine;

receive a frequency and an amplitude of the combustion pressure as measured by the combustion pressure sensor;

determine a cylinder pressure level by converting the frequency and the amplitude of the combustion pressure through a fast Fourier transform (FFT); and calculate a combustion noise index based on the cylinder pressure level;

determine the level of the combustion noise generated in the driving condition is within a predetermined range when the combustion noise index is within the predetermined range; and control the speaker to output a masking sound reducing the combustion noise to the inside of the vehicle when the level of the combustion noise is within the predetermined range.

6. The vehicle combustion noise-masking control apparatus of claim 5, wherein the speaker outputs the masking sound to have a frequency equal to or less than about 700 Hz.

* * * * *